US009279641B1

(12) United States Patent
Springsteen et al.

(10) Patent No.: US 9,279,641 B1
(45) Date of Patent: Mar. 8, 2016

(54) LIGHTWEIGHT PENETRATION RESISTANT STRUCTURE

(71) Applicant: Adams Rite Aerospace, Inc., Fullerton, CA (US)

(72) Inventors: Thomas C. Springsteen, Gilbert, AZ (US); Rockne H. Carter, Phoenix, AZ (US)

(73) Assignee: Adams Rite Aerospace, Inc., Fullerton, CA (US)

( * ) Notice: Subject to any disclaimer, the term of this patent is extended or adjusted under 35 U.S.C. 154(b) by 0 days.

(21) Appl. No.: 14/293,142

(22) Filed: Jun. 2, 2014

Related U.S. Application Data

(63) Continuation of application No. 13/152,471, filed on Jun. 3, 2011, now abandoned.

(51) Int. Cl.
*F41H 5/04* (2006.01)
*B64C 1/14* (2006.01)

(52) U.S. Cl.
CPC ..... *F41H 5/0464* (2013.01); *F41H 5/0471* (2013.01); *F41H 5/0485* (2013.01)

(58) Field of Classification Search
CPC .. B64C 1/1446; B64C 1/1469; B64C 1/1461; B64C 1/1407; B64C 1/14; B64D 7/00
USPC ..... 89/36.02, 36.11; 244/121
See application file for complete search history.

(56) References Cited

U.S. PATENT DOCUMENTS

| | | | | |
|---|---|---|---|---|
| 2,576,734 | A * | 11/1951 | Voelker | 52/309.2 |
| 3,924,038 | A * | 12/1975 | McArdle et al. | 428/49 |
| 4,241,457 | A * | 12/1980 | Klein et al. | 2/2.5 |
| 5,255,479 | A * | 10/1993 | Shepherd | 52/127.8 |
| 6,871,821 | B2 * | 3/2005 | Takahama | 244/129.5 |
| 8,777,161 | B2 * | 7/2014 | Pollock et al. | 244/121 |
| 2010/0083819 | A1 * | 4/2010 | Mann et al. | 89/36.02 |

* cited by examiner

*Primary Examiner* — Reginald Tillman, Jr.
(74) *Attorney, Agent, or Firm* — Baker & Hostetler LLP

(57) ABSTRACT

Designs and methods are provided for a lightweight ballistic panel. In one exemplary embodiment the ballistic panel comprises a lightweight structural portion comprising a structural core that is substantially rigid in a thickness direction of the ballistic panel, and a first core skin on an exterior facing surface of the structural core. The lightweight ballistic panel may further comprise a ballistic portion adjacent the opposite surface of the lightweight structural portion, the ballistic portion comprising a ballistic composite made of multiple stacked arrays of evenly spaced unidirectional ballistic fiber bundles bonded together in the absence of resin within the fiber bundles. The ballistic portion may further comprise a first ballistic skin on an exterior facing surface of the ballistic portion.

19 Claims, 11 Drawing Sheets

LIGHTWEIGHT PENETRATION RESISTANT STRUCTURE

TECHNICAL FIELD AND BACKGROUND

The present invention generally relates to anti-ballistic and penetration resistant structures, such as panels, bulkheads, and doors.

DESCRIPTION OF THE EMBODIMENTS

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
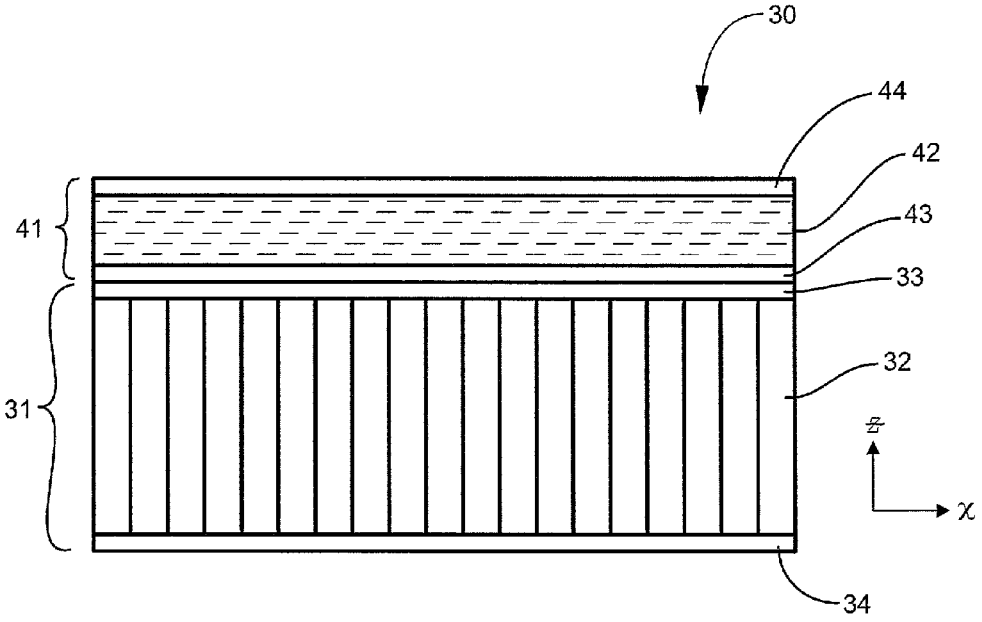
FIG. 1 is a cross section of an exemplary lightweight penetration resistant panel.

Depicted in FIG. 1 is a schematic cross-section view of an exemplary lightweight armored panel 30. The panel 30 may be adapted for use in walls, doors, dividers, bulkheads, or any structural member requiring ballistic resistance and structural integrity. In one particular embodiment, panel 30 is an aircraft panel designed to meet the FAA mandated requirements applied to aircraft interior doors and bulkheads for resistance to forcible intrusion by unauthorized persons and resistance to penetration by small arms fire and fragmentation devices.

The armored panel 30 in overview comprises a structural portion 31 made of a structural core 32 enclosed by rigid inner and outer core skins 33 and 34. Panel 30 further comprises a ballistic portion 41 consisting of a ballistic composite element 42 enclosed by inner and outer ballistic skins 43 and 44. The structural portion 31 is adhered to the ballistic portion 41 using a compatible resin or adhesive. In one embodiment of panel 30 the structural portion accounts for more than half the total thickness of the panel. For example, an exemplary panel 30 may comprise a structural portion 31 approximately 0.75 inches thick combined with a ballistic portion 41 approximately 0.35 inches thick.

The structural core 32 serves in part as a structural element of the structural portion 31, stabilizing the core skins 33, 34, and resisting the compression and shear loads imparted to the core when the panel undergoes bending or deflection. In one embodiment the physical attributes of the core material include light weight, high rigidity in the z (panel thickness) direction, and good shear strength in the x-y plane. A wide array of materials may be utilized to meet the structural needs of a core material, such as for example polymeric foam materials including Rohacell® structural foam sold by Evonik Industries, balsa wood, and various engineered structures known as honeycomb. Honeycomb is a flexible or rigid structural material that comprises a plurality of closely packed geometric cells that together form a lightweight honeycomb-shaped structure having high specific stiffness, high specific strength, and energy-absorbing characteristics. The geometric shape of honeycomb cells forming a structural core 32 may be any regular shape such as square and hexagonal, or alternatively over-expanded structures of various geometric shapes. Also suitable are reinforced honeycomb and other regular or irregular cellular frameworks.

The cells forming a honeycomb structural core 32 may be fabricated from a variety of rigid and flexible materials. For example, the cells may be formed from an aramid (aromatic polyamide) material such as Nomex®, a flame retardant meta-aramid material; Korex®, a high-strength para-aramid paper material; or Kevlar® aramid fiber honeycomb, each manufactured by E.I. duPont de Nemours and Company of Wilmington, Del. Other suitable materials non-exclusively include metals, such as aluminum, metal alloys, carbon, fiberglass, thermoplastic materials, such as polyurethane, and other materials conventionally known by those in the art for the formation of such honeycomb-shaped structures.

Each grade of honeycomb is characterized by a number of factors, including the type and strength of the honeycomb material, cell configuration, cell size and frequency, alloy and foil gauge (if an aluminum honeycomb), and density. In one exemplary embodiment, structural core 32 comprises aluminum honeycomb with cell sizes in the range of 1/16 in. to 1/4 inch, and with cell wall thickness ("foil gauge") in the range of about 0.001 in. to 0.005 inches. In one specific embodiment the structural core 32 is a 5056 aluminum alloy honeycomb with 1/8 in. cells of 0.002 in. foil gauge, approximately 0.75 in. thick, sold by Plascore Incorporated under the product designation PAMG-XR1-8.1-1/8-5056.

Core skins 33, 34 are selected from a suitably high-tensile strength material for providing strength and rigidity. In one embodiment the core skin has a tensile strength of at least 40,000 pounds per square inch, high toughness, a favorable strength-to-weight ratio, and is compatible with the resin system and other materials used in the structural core 32. Suitable materials include fiberglass woven material in 18, 20, or 22 oz. (ounce per square yard) weights and various S-glass or 7781 E-glass fabrics, such as phenolic resin prepreg material. High strength fibers such as aramid or carbon fibers, and metals such as aluminum or stainless steel may be used for core skins 33 or 34 as well. For fabric embodiments the skins may be cross plied layers of unidirectional fabric or layers of woven material. Resins used to impregnate material layers may be flame-resistant to enhance the overall fire resistance of armored panel 30. In one exemplary embodiment the core skins comprise a unidirectional cross-plied (0/90) fiberglass prepreg face sheet with a flame retardant epoxy matrix, sold by JD Lincoln of Costa Mesa Calif. under the product name Fiberply L-201.

The core skins 33, 34 may be bonded to the structural core 32 using a high strength structural adhesive material such as a urethane, thermosetting adhesive, or various epoxies. In one exemplary embodiment the adhesive is a self-priming, polyether based, low modulus aliphatic thermoplastic polyurethane film/sheet product sold by Deerfield Urethane under the name A4700. In another embodiment, the adhesive is a thermosetting epoxy structural adhesive in film form, such as Scotch Weld Structural Adhesive Film AF 163-2 sold by 3M, or NB 101 epoxy film sold by Newport Adhesives and Composites Inc. of Irvine Calif. Using film type thermosetting adhesives, the panel may be assembled with the film adhesive between the core and skins, and the entire assembly then heat cured using the manufacturer prescribed temperature and time.

Like the described embodiments of the structural portion 31, ballistic portion 41 of armored panel 30 may be a sandwich structure comprising a ballistic core 42 between inner and outer ballistic skins 43, 44. For example, ballistic core 42 may be a multi-layer stack of unidirectional fiber ballistic fabric layers, consolidated under heat and pressure into a rigid or semi-rigid composite. The fabric layers may be any high-tensile strength fabric such as are known for making ballistic resistant articles. Suitable commercially available products include fabrics made from aramid fibers such as those sold under the trademark Kevlar®, fabrics made from ultra-high molecular weight polyethylene fibers such as those sold under the trademarks Spectra® and Dyneema®, and fabrics made from polyphehylenebenzobisoxazole (PBO) fibers such as those sold under the trade name Zylon®. As used in this application, the terms "high performance fiber", "high strength fibers", and "ballistic fibers" refers to fibers having a tensile strength greater than 7 grams per denier.

In one exemplary process of fabricating a ballistic core 42, a bonding film is applied to a uniform flattened layer of parallel fibers to form a stable unidirectional sheet. Layers of the unidirectional fabric are stacked in a cross plied arrangement, such as so-called 0/90 degree cross ply, or any other angular relationship or combination of angular relationships. The stacked layers are consolidated into a semi-rigid ballistic composite under heat and pressure. The bonding film may be selected to permit flexure of the fabric layers when struck by a ballistic object.

Enhanced anti-ballistic characteristics may be obtained while optimizing use of materials in the composite. Specifically, it has been determined that a lightweight ballistic composite can be constructed of high performance ballistic fibers in the absence of adhesive resins and conventional matrix materials to hold the fibers together. By omitting the resin, the arrays of fibers directly contact each other, instead of being encapsulated and therefore separated from each other by the resin. For example, an ultra-thin film may be used both to cover the cross-plied arrays and to hold the arrays to each other. In one exemplary embodiment the percentage by weight of high strength fibers in the ballistic composite 42 is at least 80% of the total weight of the ballistic composite.

In one particular embodiment of a process for creating a ballistic composite 42, a plurality of bundles of untwisted unidirectional high performance fibers are formed into an array having a predetermined uniform number of bundles per inch of width. A bonding film or scrim is continuously laminated to one or both sides of the array of fiber bundles with heat and pressure to produce a stabilized array. The film or scrim may be a dry thermoplastic material in the form of an extremely thin, on the order of 0.0003 inches thick, fibrous non-woven film. Suitable commercially available thin fibrous thermoplastic film is sold by Spunfab Adhesive Fabrics, located in Cuyahoga Falls, Ohio. The laminating process may be performed using a laminating machine comprising a heating section, a nip roller, and a cooling section.

Two layers, or plies, of the stabilized unidirectional fiber arrays are laminated together with heat and pressure to form a cross-ply laminate in which the fiber directions of the two layers are an angle to one another. The cross-ply laminating process may include application of an additional thin film to the outside of the cross-ply laminate. Multiple layers of the cross ply laminate are stacked and bonded together under further heat and pressure to produce the ballistic composite 42. The bonding of the stacked laminates may be carried out using for example a heated mechanical press, or through a vacuum bag process performed in an oven or autoclave.

In the above described embodiments of laminating and bonding processes the bonding film material may coat the exterior surfaces of the individual fiber bundles of an array, but will not penetrate into the fiber bundles or coat the individual fibers and filaments. With the fiber bundles coated by the film on the outside surface only, the integral structure of parallel, closely bunched filaments and fibers remains intact, and intimate contact between the closely bunched filaments and fibers remains. In some cases the film may not even coat the entire outer surface of the fiber bundles, but only to a sufficient degree to properly bond adjacent arrays together.

The number of layers of ballistic material may be selected in proportion to the weight, breaking strength, and dynamic performance of the individual layers. When using aramid fiber materials as described herein, there may be for example anywhere from about 10 to 50 layers of fabric material. In one embodiment the ballistic composite 42 comprises about 30 layers of 0/90 cross plied T-Flex® ballistic fabric sold by Tech Fiber of Tempe, Ariz. Additional methods of fabricating a lightweight high strength fiber composite suitable for use in the ballistic material portions of the present invention are disclosed in U.S. Pat. Nos. 5,437,905, 5,635,288; 5,935,678; 6,651,543; each of which is hereby incorporated by reference.

Ballistic skins 43, 44 add strength to the ballistic composite 42 as well as participate in arresting the progress of a projectile striking the panel 30. Outer ballistic skin 44 in particular may additionally serve as a durability layer, with sufficient stiffness and toughness properties to withstand normal wear and tear for a particular application. Ballistic skins 43, 44 may comprise a rigid composite material such as fiberglass or any of the composite structural materials previously discussed in reference to the core skins 33, 34. For example the ballistic skins 43, 44 may be pre-preg fiberglass sheets that are adhered to the ballistic composite 42 during the same hot press process used to consolidate the composite layers. Additional adhesive may be used, or bonding could rely entirely on the resins contained in the pre-preg and the film attached to the ballistic fabric layers. In one particular embodiment the face skins 43, 44 are made of a 7781 E-glass solution coated epoxy pre-preg sold under the trade name L-530 by J.D. Lincoln inc. of Costa Mesa Calif.

The armored panel 30 is assembled by bonding the structural portion 31 to the ballistic portion 41 using a suitable adhesive. Preferred adhesive qualities for joining the panels include good flexibility for ballistic performance, and relatively low temperature application to avoid loosening of adhesives used in construction of the structural and ballistic portions. In one exemplary embodiment the bond is achieved with an adhesive transfer tape sold under the trade name VHB F9469PC by 3M Corporation of Minneapolis Minn. Alternatively, all of the layers comprising the ballistic and structural portions may be assembled and bonded at one time.

Figure 2:
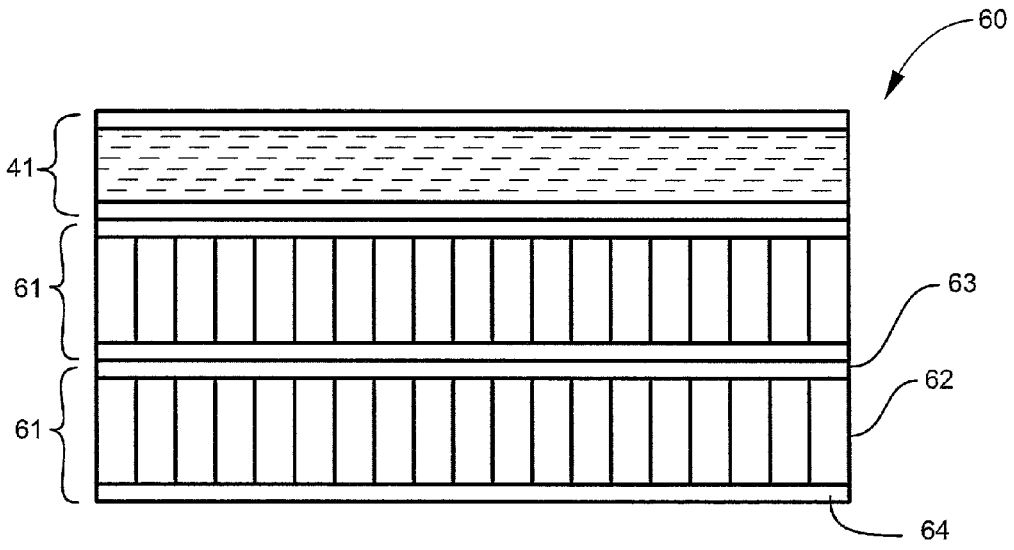
FIG. 2 is cross section view of an exemplary lightweight penetration resistant panel made with two structural layers.

FIG. 2 shows an alternative construction to that of FIG. 1 in which the structural portion of an armored panel 60 is comprised of two structural portions 61. Each structural portion 61 is constructed of a structural core 62 sandwiched between core skins 63 and 64. Depending upon the particular application, the materials, dimensions, and adhesives used in construction of structural portion 61 may, or may not be the same as those used for structural portion 31. In one exemplary embodiment the structural cores 62 are both the Plascore PAMG-XR1-8.1-1/8-5056 aluminum honeycomb, each approximately 0.37 in. thick; and the core skins 63, 64 are each the JD Lincoln Fiberply L-201 cross plied prepreg fiberglass. The component elements of structural portions 61 may each be assembled into unitized panels as previously described with reference to structural portion 31 of panel 30. The structures 61 along with ballistic portion 41 may be bonded together using suitable adhesive layers 51 such as for example the previously noted 3M VHB F9473PC adhesive transfer tape. Alternatively, all of the layers comprising the ballistic portion 41 and structural portions 61 may be assembled and bonded at one time.

Figure 3:
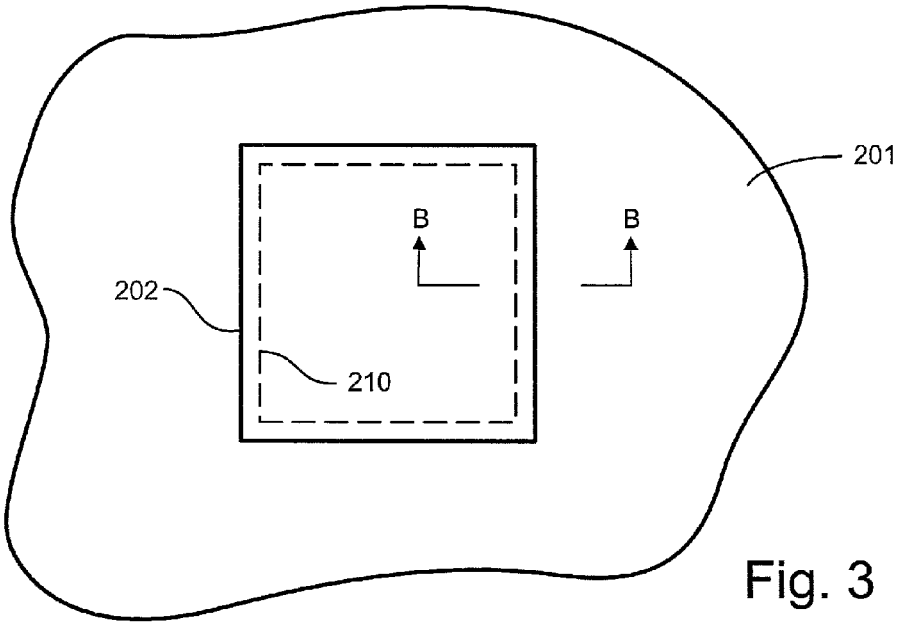
FIG. 3 depicts a portion of a penetration resistant panel containing a removable hatch.
Figure 4:
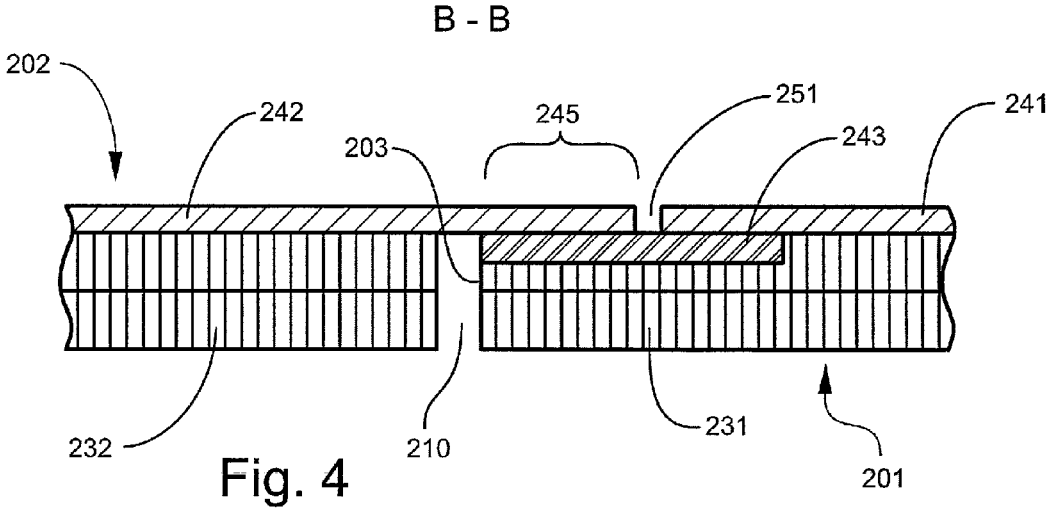
FIG. 4 is a cross section through the panel and hatch of FIG. 3 showing a perimeter flange overlapping the seam between the hatch and panel.

An armored assembly may further comprise a movable hatch or door within a larger panel or door, such as for example a decompression hatch located in a door or bulkhead of an aircraft. FIGS. 3 and 4 depict a ballistic panel 201 containing a hatch 202, wherein the ballistic panel 201 comprises a structural portion 231 and ballistic portion 241; and hatch 202 comprises a structural portion 232 and ballistic portion 242. A seam 210 is defined between the edge of a hole 203 in the panel 201 and the edge of the hatch 202. The ballistic portion 242 of hatch 202 extends beyond the edge of the structural portion 232, creating a perimeter flange 245. The perimeter flange 245 and ballistic portion 242 may comprise for example a ballistic fiber composite layer and a fiberglass outer skin. As shown in FIG. 4, the ballistic portion 241 of panel 201 is recessed from the edge of hole 203, creating a notch for receiving perimeter flange 245. The perimeter flange 245 thus overlaps the seam 210 and the notched portion of the edge of panel 201 on the side from which a potential attack would be expected to come, referred to herein as the "threat side".

A threat side seam 251 is defined between the outer edge of perimeter flange 245 and the recessed edge of ballistic portion 241 of panel 201. In one embodiment an armor plate 243 is embedded in the structural portion 231 of panel 201 beneath seam 251. The armor plate 243 is overlapped by both the ballistic portion 241 of the panel 201, and the perimeter flange 245 extending from the edge of hatch 202. The armor plate 243 may comprise segments, or one contiguous piece circumscribing hole 203. The armor plate 243 may be made of any high strength or ballistic resistant material, such as steel, titanium, aluminum, or composites such as high strength polymer fiber composites, fiberglass, or carbon composite laminates. In one exemplary embodiment, the armor plate 243 is one contiguous rectangular component made of "S-glass" structural fiberglass sheet.

Figure 5:
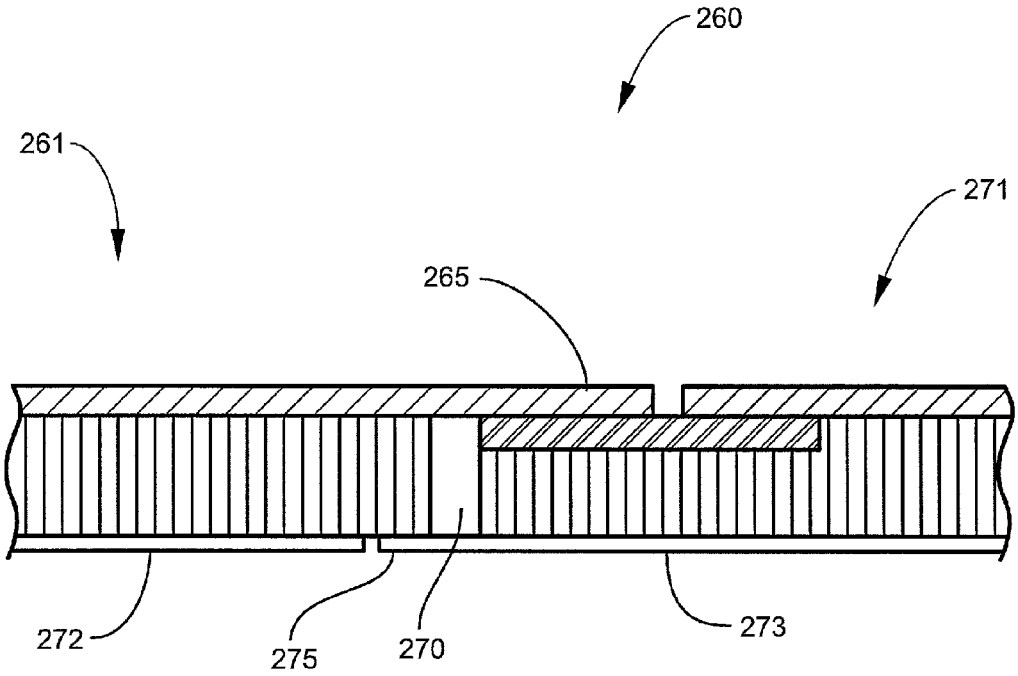
FIG. 5 is a cross section through two adjacent penetration resistant panels, with an outer skin overlapping the seam between the panels on the protected side.

FIG. 5 depicts another two-panel assembly 260, in which a first panel 261 includes a perimeter flange 265 that overlaps a portion of an adjacent coplanar second panel 271. The panels may be of the same construction described above in reference to panel 201 and hatch 202. In particular, perimeter flange 265 may comprise a ballistic fiber composite layer on the threat side of the first panel that covers a seam 270 between the first and second panels.

The panels of FIG. 5 may further comprise outer skins 272 and 273 on the protected side of the first and second panels respectively. The outer skin 273 extends beyond the edge of second panel 271, creating a perimeter flange 275 similar to perimeter flange 265 on the threat side of the first panel 261. The perimeter flange 275 overlaps a portion of the protected side (the side opposite the threat side) of the first panel. Skin 272 of first panel 261 may be recessed away from the edge as shown to create a notch for receiving flange 275. The flange 275 may be comprised of any rigid material, such as fiberglass or sheet metal, with enough stiffness to deflect material particles that may be ejected through seam 270 from a ballistic impact on or near perimeter flange 265. In one embodiment the outer skin 273 and flange 275 of the second panel 271 comprise the outer skin of the panel. In another embodiment, outer skin 273 and flange 275 comprise a separate layer that overlies an outer skin of second panel 271 and first panel 261.

Figure 6:
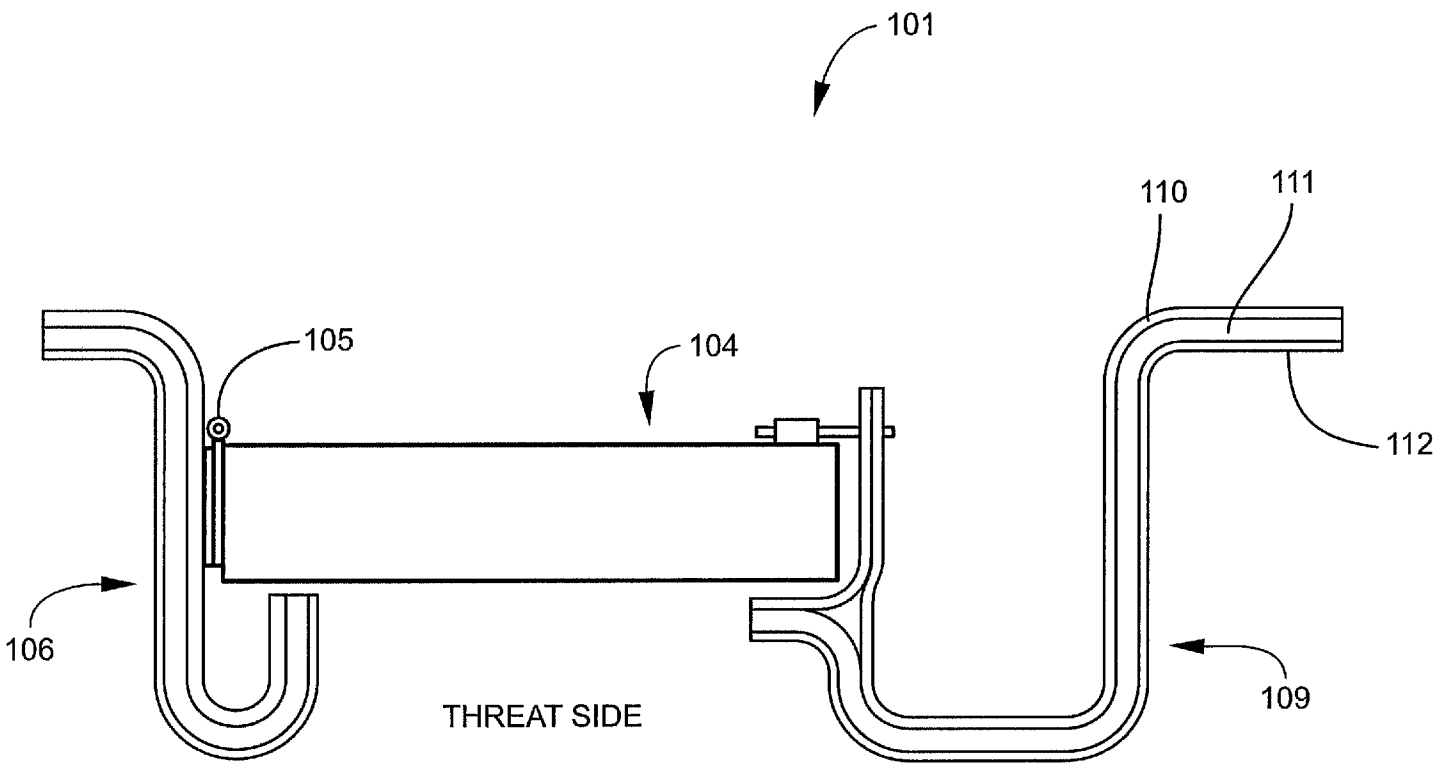
FIG. 6 is a stylized cross section through door posts and a door panel of a lightweight penetration resistant door assembly.

FIG. 6 illustrates an exemplary bullet proof door assembly 101 comprising a ballistic door 104 mounted via hinges 105 to a hinge-side ballistic frame member 106, and a latch-side ballistic frame member 109. Door posts 106 and 109 may comprise a frame 110, a ballistic composite blanket 111, and an outer shell 112. In one preferred embodiment the door posts are oriented such that the outer shell 112 is on the threat side. Accordingly the door may be configured as shown, with the door 104 positioned to abut the door posts from the protected side, and door posts configured with the outer shell 112 facing the threat side.

The metal frame 110 of door posts 106 and 109 may be a high strength, light weight structural material such as aluminum, magnesium, or various composites. In one embodiment a suitable frame 110 is fabricated from high strength aircraft grade aluminum, such as 6061 T-6. The frame members may be fabricated by various methods, such as extrusion, molding, casting, and forming. Additionally, the frames may comprise any cross-sectional shape such as for example the contoured shapes depicted, or vary in cross-sectional shape. The outer shell 112 may be fabricated from any rigid and durable material such as fiberglass or metal. In one preferred embodiment, the shell 112 is fabricated from stainless steel sheet of between approximately 0.016 and 0.036 inches in thickness.

The ballistic composite blanket 111 may be a consolidated, multi-layer stack of unidirectional fiber ballistic fabric layers of the same type described above in reference to ballistic composite 42. In one exemplary embodiment the composite blanket 111 comprises 30 layers of 0/90 cross plied T-Flex® unidirectional ballistic fabric. The composite blanket 111 may be consolidated separately from or together with frame 110. In one embodiment the composite blanket 111 is molded and cured to a desired contoured shape before being combined with the door frame 110. The composite blanket 111 may also be bonded to one or both of the frame 110 and outer shell 112. Bonding may be carried out with any of the thermoplastic resins or epoxy type adhesives discussed above for example with respect to attaching skins to cores. Exemplary bonding materials include A4700 Urethane sold by Deerfield Urethane, and Scotch Weld AF-163-2 manufactured and sold by 3M.

Figure 7:
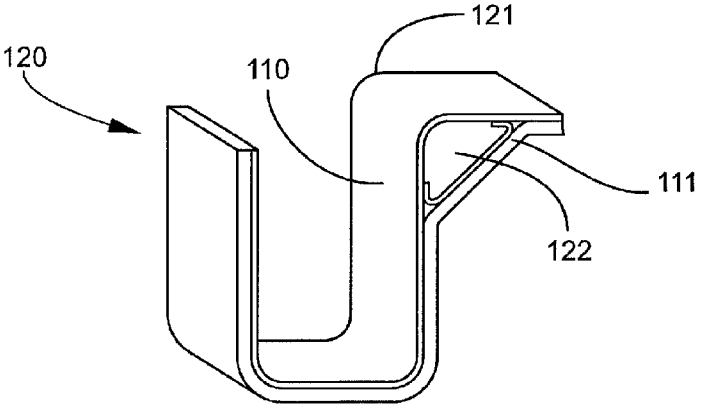
FIGS. 7-9 depict various penetration resistant door post configurations in which a space is created in certain areas between the ballistic composite and the underlying frame.
Figure 8:
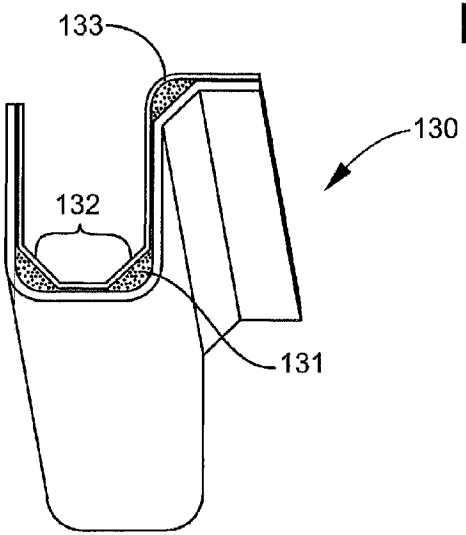
Figure 9:
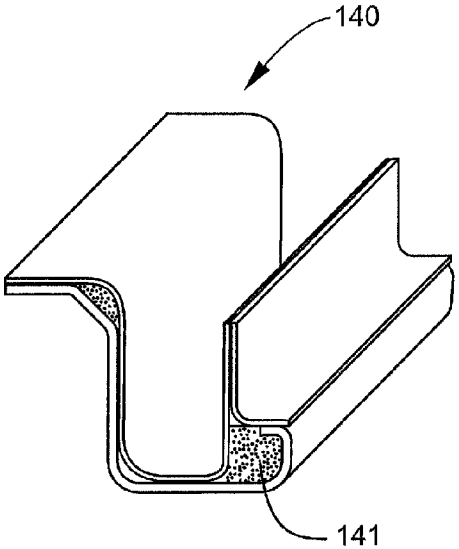

FIGS. 7 through 9 illustrate various embodiments of the door posts in which a gap is provided between the ballistic blanket 111 and the frame 110 in certain areas. The inventors have discovered that the ability of the door posts to stop a ballistic projectile is substantially reduced in areas of a cross-section that are not straight, such as the corner areas. In FIG. 7 form example, a door post 120 comprises an inside corner 121 (when viewed from the threat side) where the ballistic blanket 111 has been spaced away from the door frame 110 by a relatively thin and flexible spacer strip 122. The spacer strip may be any flexible material such as for example thin sheet metal. The effect of the spacer strip 122 is to replace the relatively sharp inside corner with a large, flat 45 degree surface that flexibly supports the ballistic blanket, and provides a space between the ballistic blanket and the relatively rigid door frame corner into which the ballistic blanket and spacer strip can deflect.

Alternatively as shown in FIGS. 8 and 9, a rigid but crushable material such as structural foam is used to support the ballistic blanket in a spaced relationship to critical areas of the underlying door frame. In the embodiment of FIG. 8 for example, a door post 130 incorporates a foam spacer 131 on outside corners between the ballistic blanket material and the door frame. Beveled outside door frame corners 132 provide for additional spacing and foam volume. Another foam spacer is used to treat the inside corner 133 in much the same way as the flexible spacer strip 122 of the FIG. 7 embodiment. In the embodiment of FIG. 9, a foam block 141 is used to completely fill an inside corner of the door post 140, eliminating the inside corner from the ballistic blanket. The foam spacers may be molded in place, or pre-formed to the desired dimensions and then bonded to the door frame. In one exemplary embodiment the foam material is pre-formed, and made of a rigid structural foam sold by Evonik Industries of Germany under the trade name Rohacell® IG/IG-F. Alternatively, spacing between the ballistic blanket and the door frame may be achieved without use of any type of spacer strip or foam by simply molding the ballistic blanket to a shape that creates the desired spacing.

Figure 10:
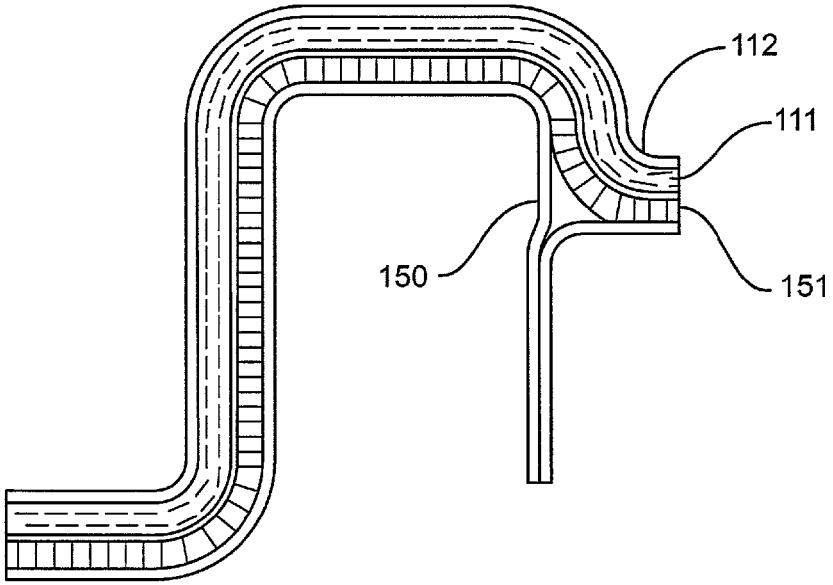
FIG. 10 is a cross section through a door post with a crushable layer between the ballistic composite and the rigid frame.

FIG. 10 illustrates another embodiment of the invention in which the concept of using a spacer material to separate the ballistic blanket from the underlying door frame has been extended to the entire surface of the door frame. In particular, overlying the threat side of a door frame 150 is a crushable spacer layer 151, a ballistic blanket 111, and an outer shell 112. The crushable spacer layer 151 may be any rigid, crushable material such as the crushable foams discussed in reference to FIGS. 8 and 9, or the honeycomb materials previously described with respect to the door panels. The spacer layer 151 may be bonded to the door frame and ballistic blanket with a suitable adhesive, such as any of the previously described resins, epoxies, or transfer tapes.

It should be noted that the depicted cross-sectional shapes of the door posts are purely exemplary, and that the constructions and materials disclosed herein apply to door posts of various shapes or designs. For example, instead of the contoured shapes shown in FIG. 4, a door post could be simply a flat plate, a channel that fits around the edge of a panel, or any other shape. The arrangement and orientation of the elements of the door posts are also not intended to be exclusive. For example, the ballistic composite blanket 111 could be on the protected side of the door frame 110, such that a ballistic projectile from the threat side would encounter the ballistic composite blanket 111 after penetrating the door frame 110. Various other foreseeable arrangements not specifically mentioned are likewise not intended to be excluded the scope of the present invention.

Figure 11:
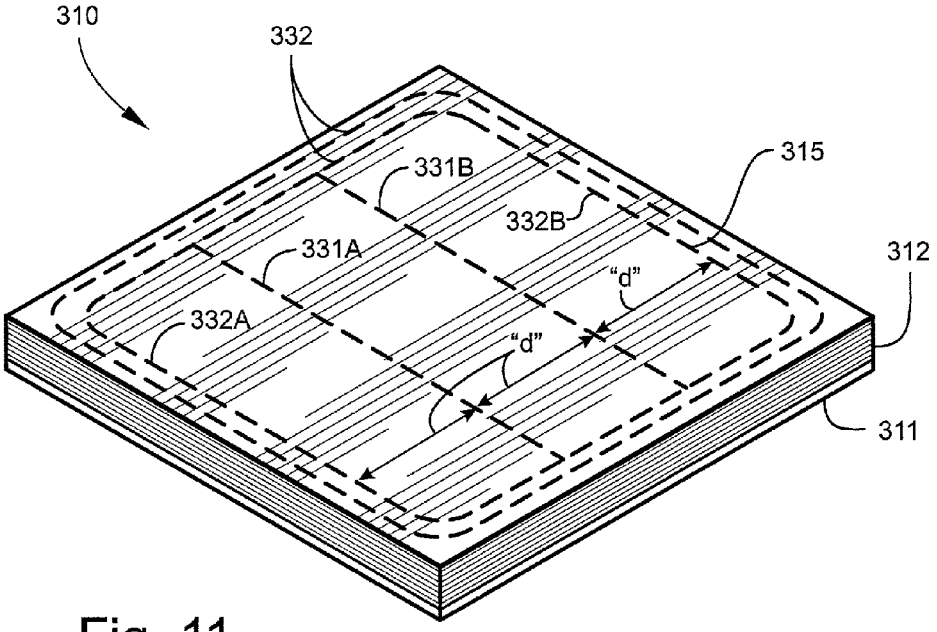
FIGS. 11 and 12 depict an exemplary ballistic fabric composite portion of a penetration resistant panel with stitched reinforcement.
Figure 12:
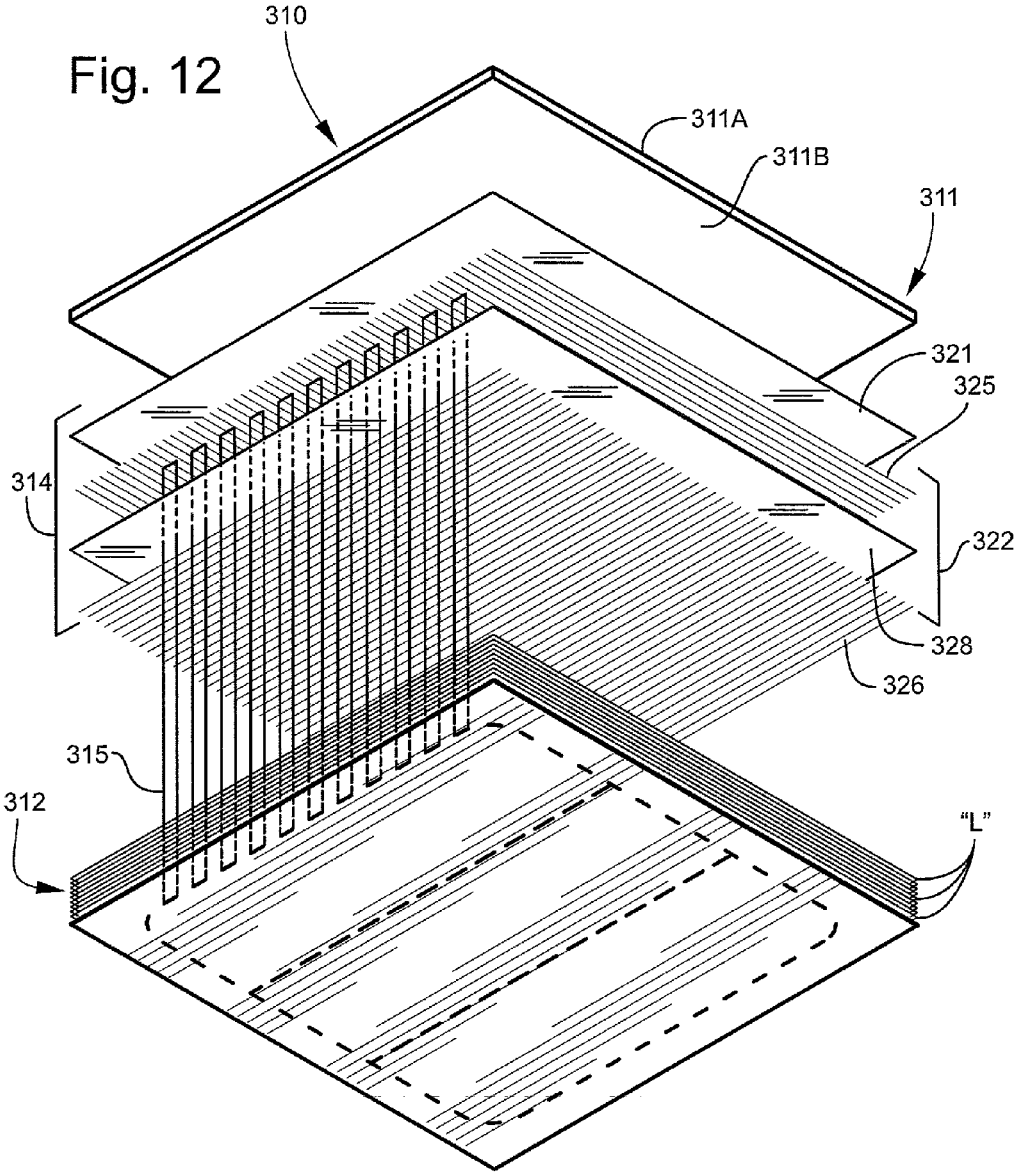

The ballistic composite portions of the panels and door posts of the present invention, such as ballistic portions 41, 61, 241, 242, and ballistic blanket 111, may further include reinforcement stitching. Referring to FIGS. 11 and 12, an exemplary ballistic assembly 310 comprises a flexible ballistic fiber composite 312, a rigid panel 311, a panel/composite interface 314, and high-strength sewing thread 315. The exemplary panel 311 includes an outside major surface 311A, and an opposing inside major surface 311 B. The rigid panel 311 may correspond for example to one or both of the ballistic skins 43, 44 facing the ballistic composite 42 of FIG. 1, or a separate dedicated rigid layer facing a flexible ballistic fiber composite, alone or in combination with external skins such as skins 43, 44.

The composite 312 is formed of multiple overlying layers of ballistic yarns comprising continuous high-strength, high-modulus fibers of the type and construction described herein. The exemplary fabric composite 312 may comprise between 10 and 35 overlying layers "L" of ballistic yarns. The individual layers "L" may be consolidated under heat and pressure, and stitched together using the high-strength thread 315, as discussed below, before or after being consolidated.

The panel/composite interface 314 resides between the rigid panel 311 and composite 312, as shown in FIG. 12, and may comprise an adhesive 321 and cross-plied ballistic fabric 322. The panel/composite interface 314 forms an expansive bonding joint (or "bonding zone") which cooperates with the high-strength thread 315 to mitigate damage to, and delamination of the composite 312 from ballistic impact. The bonding joint may cover substantially the entire inside major surface 311 B of the rigid panel 311. The adhesive 321 may be a thermoplastic urethane film or other suitable polymer film, resin, or bonding agent previously discussed.

Continuing with FIGS. 11 and 12, a high-strength thread 315 is passed (e.g., sewn) through all layers "L" of a composite laminate 312 and extends around the unidirectional panel-side yarns 325 of the panel/composite interface 314 along continuous linear stitch lines 331A, 331 B running substantially perpendicular to the yarn orientation. Two or more ends of high-strength thread 315 may be used in a lockstitch sewing technique commonly known in the industry. The stitched thread 315 cooperates with the panel-side ballistic yarns 325 to promote increased joint resistance against tensile loadings and ballistic impacts, in-plane shear, and anti-plane shear. As best shown in FIG. 11, the exemplary ballistic assembly 310 may include multiple, equally spaced, parallel lines 331A, 331 B of stitching which run substantially continuously from one edge of the flexible backing 312 to the opposite edge. In one embodiment the stitch lines 331A, 331B are spaced apart approximately 2-6 inches, and comprise approximately 4 stitches per linear inch. The high-strength thread 315 may provide structural reinforcement and enhanced energy absorption along a z-axis of the ballistic assembly 310.

The ballistic assembly 310 may further include one or more rows of a continuous perimeter stitch 332 running along adjacent marginal edges of the composite 312. Opposing linear segments 332A, 332B of the perimeter stitch 332 may be substantially parallel to respective stitch lines 331A and 331 B, and may be spaced such that the distance "d" between adjacent parallel stitch lines is substantially equal. In one exemplary embodiment, the continuous perimeter stitch 332 comprises two rows of stitches spaced approximately one half inch apart, with the outermost stitch spaced approximately one half inch from the perimeter edge of the composite 312. The exemplary high-strength thread 315 comprises fibers having high tensile strength, elastic modulus, and strain to failure. For example, such fibers may have a tensile strength greater than about 2000 MPa and an elastic modulus greater than about 60 GPa.

Figure 13:
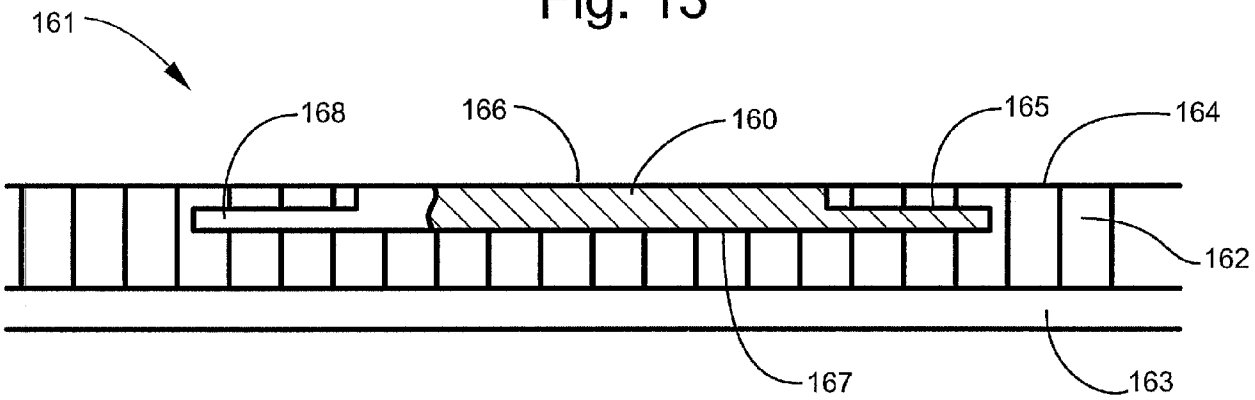
FIG. 13 is a cross section of a penetration resistant panel containing a hardware mounting plate with a perimeter flange.
Figure 14:
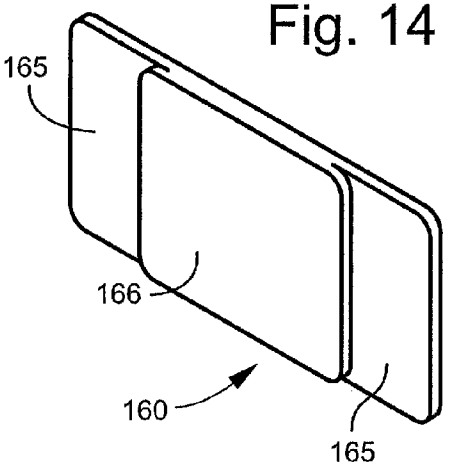
FIG. 14 is a perspective view of the hardware mounting plate of FIG. 13.

FIGS. 13 and 14 illustrate a ballistic resistant mounting plate for attaching hardware and load carrying items such as latches, deadbolts, hinges, seats, and the like to a lightweight ballistic panel assembly. A metal mounting plate 160 is recessed within a ballistic panel assembly 161, comprising structural portion 162, and a ballistic portion 163. The structural and ballistic portions 162, 163 may comprise the previously described core and skin constructions of portions 31 and 41 of panel 30 for example. An outer surface 166 of mounting plate 160 is substantially flush with the back surface 164 of the panel assembly 161, and an inner surface 167 of plate 160 is recessed within the structural portion 162. The outer surface provides a hardware mounting surface, and may incorporate for example threaded holes suitable for hardware attachment.

The mounting plate 160 includes a perimeter portion that is relatively soft or bendable compared to the main, central portion of the plate. For example, in one embodiment the perimeter portion comprises flanges 165 extending from some or all edges of the plate 160. The flanges 165 are thinner than rest of the plate 160, and in one embodiment are less than half the thickness of plate 160. Notches 168 in the structural portion 162 receive the flanges 165, trapping the mounting plate in the panel assembly in the structural material. Installation of the mounting plate may be simplified for panels comprising two structural portions 162 like the construction depicted in FIG. 2. In that case, rather than creating a notch to receive flange 165, the mounting plate may be simply recessed into the inner facing surface of the structural portion containing the mounting plate prior to bonding the two structural portions together.

Figure 15:
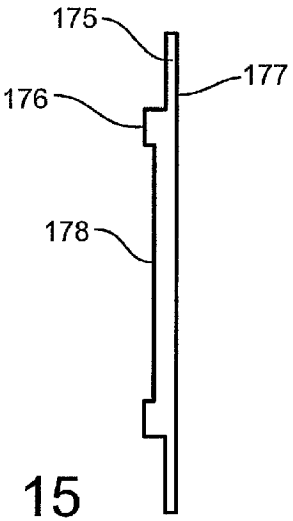
FIG. 15 is a cross section view of a hardware mounting plate with a perimeter flange and a recess in the outer facing surface.

Illustrated in FIG. 15 is an alternative hardware mounting plate 170 comprising an outer surface 176, inner surface 177, and a relatively flexible perimeter flange 175 on two or more sides of plate 170. Mounting plate 170 further comprises a broad recess 178 in the central portion of the outer surface 176. The recess 178 may cover most of the area of the outer surface 176 as shown. The recess 178 in mounting plate 170 may be utilized to create a gap between the mounting plate and any hardware component or mechanism attached to the plate, where the size of the gap is defined by the depth of the recess. The gap allows for plate 170 to deflect to a certain extent toward a component attached to outer surface 176 before coming into physical contact with the component.

Figure 16:
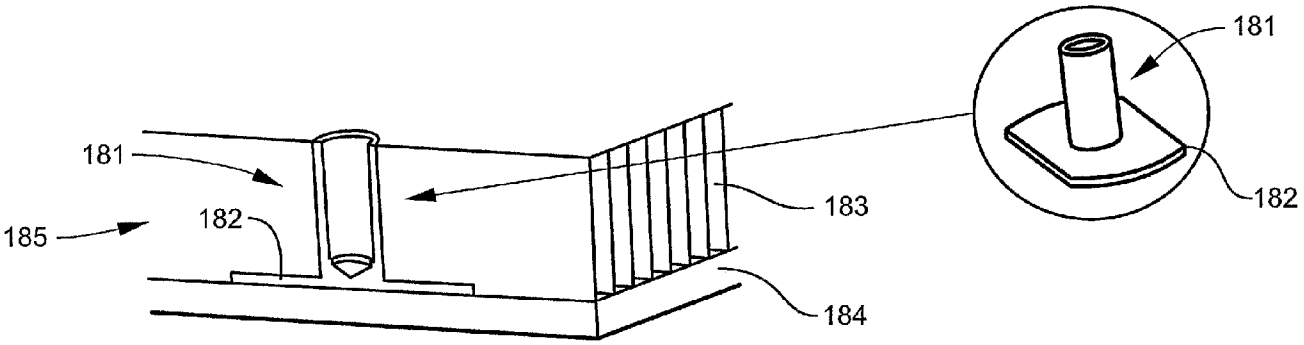
FIGS. 16 and 17 depict threaded inserts with oversized mounting flanges installed in a penetration resistant panel.
Figure 17:
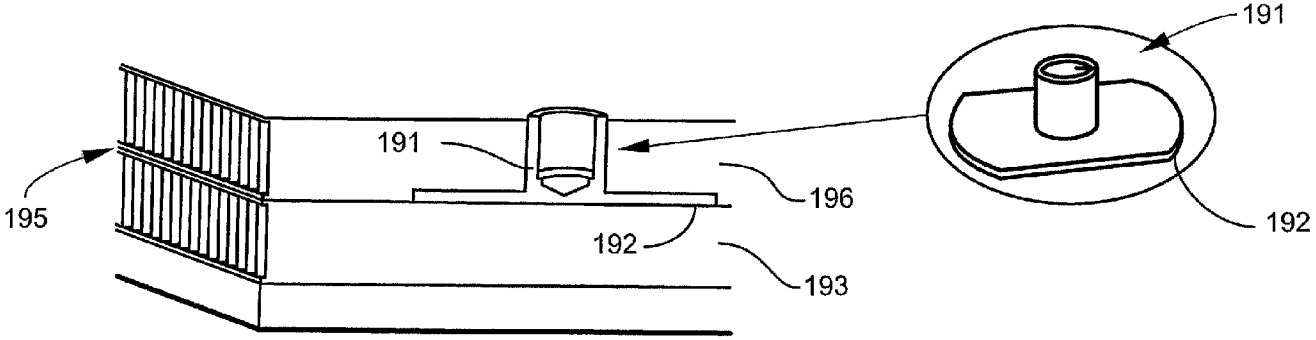

FIGS. 16 and 17 illustrate a threaded insert design that utilizes a relatively large perimeter flange. Threaded inserts may be utilized for attaching various hardware components to lightweight ballistic panels, such as for example hinges and latches. FIG. 16 depicts one embodiment of a threaded insert 181 having a flange portion 182 extending laterally from the base of the insert. The width or diameter of flange portion 182 may be approximately two to four times the diameter of the body portion of the insert. In one version the flange portion 182 is also relatively thin and flexible compared to the body portion of the insert 181. Insert 181 is mounted in a ballistic panel 185 comprising a ballistic portion 184, and a structural portions 183, with the insert oriented to protrude on the side of panel 185 opposite the ballistic portion 184. The flange 182 is countersunk flush with the surface of structural portion 183 facing the ballistic portion 184, trapping the flange between the ballistic portion and the structural portion.

FIG. 17 depicts a shorter flanged insert 191 with an oversized flange 192. In this embodiment the insert 191 is mounted in a ballistic panel 195 that includes two structural portions, 193 and 196, instead of the single structural portion of the FIG. 16 embodiment. The insert 191 is again oriented such that the threaded end protrudes on the structural side of the panel. In this embodiment the flange 192 is recessed in the surface of structural portion 196 that faces structural portion 193, trapping the flange between the structural portions in the middle of panel 195 instead of between the ballistic portion and structural portion as in the FIG. 16 embodiment.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A lightweight ballistic panel assembly for use between an aircraft cockpit and passenger compartment, comprising:

a first panel comprising a first ballistic composite layer and a first lightweight structural core, the first panel having a first edge;

a second panel coplanar to the first panel with a second edge adjacent the first edge of the first panel defining a first seam between the two panels, the second panel comprising a second ballistic composite layer and a second lightweight structural core, wherein the second ballistic composite layer extends substantially beyond the second lightweight structural core to define a first perimeter flange that overlaps the first seam;

a first rigid outer skin on a surface of the first structural core opposite the first ballistic composite layer, and a second rigid outer skin on a surface of the second lightweight structural core opposite the second ballistic composite layer, wherein the first rigid outer skin extends beyond the first edge of the first panel to define a second perimeter flange that overlaps the first seam on a side opposite the first perimeter flange;

an armor plate recessed in the first lightweight structural core of the first panel beneath a second seam formed between the edge of the first perimeter flange and the recessed edge of the first ballistic composite layer; and wherein the first panel and second panel are configured to form a movable hatch.

2. The lightweight ballistic panel assembly of claim 1, wherein the first ballistic composite layer is recessed from the first edge of the first panel to define a notch for receiving the perimeter flange of the second panel.

3. The lightweight ballistic panel assembly of claim 1, wherein a portion of the armor plate is overlapped by the first perimeter flange of the second panel, and another portion of the armor plate is overlapped by the first ballistic composite layer of the first panel.

4. The lightweight ballistic panel assembly of claim 3, wherein the armor plate comprises segments.

5. The lightweight ballistic panel assembly of claim 3, wherein the armor plate material is one of the group comprising steel, titanium, aluminum, high strength polymer fiber composites, fiberglass, and carbon composites.

6. The lightweight ballistic panel assembly of claim 5, wherein the armor plate is made of S-glass structural fiberglass.

7. The lightweight ballistic panel assembly of claim 1, wherein the first panel is a cockpit door.

8. The lightweight ballistic panel of claim 1, wherein the second rigid outer skin is recessed from the second edge of the second panel to define a notch for receiving the second perimeter flange.

9. The lightweight ballistic panel assembly of claim 8, wherein the first and second outer skins are made of fiberglass.

10. The lightweight ballistic panel assembly of claim 9, wherein the first and second structural cores are made of aluminum honeycomb.

11. The lightweight ballistic panel assembly of claim 1, wherein the ballistic composite layers comprise multiple stacked layers of unidirectional ballistic fiber bundles bonded together.

12. A lightweight ballistic panel assembly for use between an aircraft cockpit and passenger compartment, comprising:

a panel comprising a first ballistic composite layer and a first lightweight structural core, the panel having an opening therein defined by an edge;

a movable hatch configured to fit the opening in the panel, the hatch comprising a second ballistic composite layer and a second lightweight structural core, wherein the second ballistic composite layer extends substantially beyond the second lightweight structural core at a perimeter edge of the hatch defining a perimeter flange configured to overlap a first seam between the edge of the opening in the panel and the perimeter edge of the hatch and wherein the first ballistic composite layer is recessed from the edge of the panel to define a notch for receiving the perimeter flange of the hatch; and an armor plate recessed in the first lightweight structural core of the panel beneath a second seam formed between the edge of the hatch perimeter flange and the recessed edge of the first ballistic composite layer.

13. The lightweight ballistic panel assembly of claim 12, wherein the first and second structural cores are made of aluminum honeycomb.

14. The lightweight ballistic panel assembly of claim 13, wherein the ballistic composite layers comprise multiple stacked layers of unidirectional ballistic fiber bundles bonded together.

15. The lightweight ballistic panel assembly of claim 12, wherein a portion of the armor plate is overlapped by the hatch perimeter flange, and another portion of the armor plate is overlapped by the first ballistic composite layer of the panel.

16. The lightweight ballistic panel assembly of claim 1, wherein a ballistic resistant mounting plate is recessed within the ballistic panel assembly.

17. The lightweight ballistic panel assembly of claim 12, wherein a ballistic resistant mounting plate is recessed within the ballistic panel assembly.

18. The lightweight ballistic panel assembly of claim 1, wherein the armor plate comprises a rectangular shape with a rectangular opening therein to receive the hatch.

19. The lightweight ballistic panel assembly of claim 12, wherein the armor plate comprises a rectangular shape with a rectangular opening therein to receive the hatch.

* * * * *